US009492861B2

(12) United States Patent
Blei

(10) Patent No.: US 9,492,861 B2
(45) Date of Patent: Nov. 15, 2016

(54) DEVICE AND METHOD FOR PRODUCING CAN BODIES, COMPRISING A CUTTING DEVICE

(75) Inventor: Klaus Blei, Wangen (DE)

(73) Assignee: SCHULER PRESSEN GMBH, Goeppingen (DE)

( * ) Notice: Subject to any disclaimer, the term of this patent is extended or adjusted under 35 U.S.C. 154(b) by 204 days.

(21) Appl. No.: 14/241,825

(22) PCT Filed: Jul. 16, 2012

(86) PCT No.: PCT/EP2012/063909

§ 371 (c)(1),
(2), (4) Date: Feb. 27, 2014

(87) PCT Pub. No.: WO2013/029863

PCT Pub. Date: Mar. 7, 2013

(65) Prior Publication Data

US 2014/0366603 A1 Dec. 18, 2014

(30) Foreign Application Priority Data

Aug. 29, 2011 (DE) ..... 10 2011 053 084

(51) Int. Cl.
*B21D 51/26* (2006.01)
*B21D 26/14* (2006.01)
(Continued)

(52) U.S. Cl.
CPC ..... *B21D 51/26* (2013.01); *B21D 22/20* (2013.01); *B21D 24/16* (2013.01); *B21D 26/14* (2013.01)

(58) Field of Classification Search
CPC ..... B21D 26/14; B21D 51/26; B21D 22/20; B21D 24/16
See application file for complete search history.

(56) References Cited

U.S. PATENT DOCUMENTS 3,286,497 A * 11/1966 Cary ..... B21D 26/14 413/69
3,288,006 A * 11/1966 Erlandson ..... B21D 26/14 29/421.1
(Continued)

FOREIGN PATENT DOCUMENTS

DE 102010019323.2 A1 11/2011
GB 2259880 A * 3/1993 ..... B21D 22/21
(Continued)

OTHER PUBLICATIONS

International Search Report for PCT/EP2012/063909 dated Sep. 13, 2012.
(Continued)

*Primary Examiner* — Jimmy T Nguyen
*Assistant Examiner* — Gregory Swiatocha
(74) *Attorney, Agent, or Firm* — Fitch, Even, Tabin & Flannery LLP

(57) ABSTRACT

A can body (II) having a can base (13) and a can wall (14) is shaped by a wall ironing process starting with a blank (12). A drawing punch (15) moves the blank (12) through a wall ironing container (34) from an opening (35) to an exit (36). The edge (R) of the can body (II) opposite the can base (13) is separated using a cutting device (45), which has a force generating unit (46) arranged adjacent to the exit (36) and at least one cutting edge (26, 27) which can be arranged on the drawing punch (15). The force generating unit (46) generates a force (F) onto the can wall (14) edge (R) to be separated, whereby the edge is sheared off on the at least one cutting edge (26, 27). The can body (II) is located on the drawing punch (15) while the edge (R) is being separated.

10 Claims, 7 Drawing Sheets

(51) Int. Cl.
*B21D 24/16* (2006.01)
*B21D 22/20* (2006.01)

(56) References Cited

U.S. PATENT DOCUMENTS

| | | | | |
|---|---|---|---|---|
| 3,383,888 | A * | 5/1968 | Aschberger | B21D 26/14 226/196.1 |
| 4,028,459 | A * | 6/1977 | LaJovic | B21D 51/36 264/159 |
| 7,891,226 | B2 * | 2/2011 | Seo | B21D 22/22 269/8 |
| 2003/0145695 | A1 * | 8/2003 | Dickey | B23D 31/001 82/57 |
| 2011/0265545 | A1 | 11/2011 | Blei et al. | |

FOREIGN PATENT DOCUMENTS

| | | | |
|---|---|---|---|
| GB | 2183195 | A | 6/1997 |
| WO | WO9944766 | A1 | 9/1999 |

OTHER PUBLICATIONS

Office Action in British Application No. GB1403460.7, dated Feb. 19, 2016, 1 page.

* cited by examiner

DEVICE AND METHOD FOR PRODUCING CAN BODIES, COMPRISING A CUTTING DEVICE

CROSS REFERENCE TO RELATED APPLICATIONS

This patent application is the national phase of PCT/EP2012/063909 filed Jul. 16, 2012, which claims the benefit of German Patent Application No. DE 102011053084.3 filed Aug. 29, 2011 each of which is incorporated by reference as if fully re-written herein.

TECHNICAL FIELD

The invention relates to a device and to a method for producing can bodies, for example pressure container cans or beverage cans.

BACKGROUND

The can body can be produced by means of reshaping, for example from a bowl-shaped or cup-shaped blank in a wall ironing process. In the alternative, the production can also be made from a flat, round piece of sheet metal, which is provided as blank. A wall ironing process also takes place herein, in the case of which the blank is finally shaped into the can body. The can body encompasses a can base and an adjoining can wall. The can base and the can wall consist of a uniform material and merge without a seam or joint. The can body has a cylindrical contour.

A device for producing a can body is known is known, for example, from German patent application 10 2010 019 323.2 by the patent applicant.

After producing the can bodies, a further processing is required. On principle, the rim of the can wall opposite the can base is not sufficiently flat due to the type of production of the can body. In response to a further processing, it is thus necessary to establish a smooth and flat edge at this rim of the can body.

SUMMARY

Based on this, it can be considered to be the task of the instant invention to create a device and a method for producing a can body, which simplifies the finishing of the can body.

A drawing punch, which, using a wall ironing process, moves the blank through a wall ironing container from an opening to an exit, serves the purpose of shaping the preferably bowl-shaped blank, which is also identified as "cup". A plurality of wall ironing rings having different diameters are preferably arranged in the wall ironing container, so that the wall thickness of the can wall and of the can base changes gradually when the blank is pressed through the wall ironing rings, until the desired shape and wall thickness has finally been reached and the can body has been produced.

According to the invention, the device encompasses a cutting device. The cutting device is equipped to cut off the rim of the can body or of the can wall, respectively, opposite the can base immediately after the wall ironing process, so as to obtain a flat, smooth edge at the can wall. In the case of the method according to the invention, this separating process takes place as long as the can body is still located on the drawing punch. Preferably, a part of the cutting device, in particular at least one cutting edge, is arranged on the drawing punch. Following the cut-off of the rim from the can body, the rim can be removed or stripped from the drawing punch, so that it moves back into its initial position through the wall ironing container without the can body.

By means of the embodiment of the device and of the method according to the invention, the can body can be shaped by means of a wall ironing process in a clamping and the rim of the can wall opposite the can base can be processed, so that a smooth edge is created. Compared with current methods, the total time for producing such a reworked can body can be reduced. This also increases the productivity. A repeated clamping of the can body for processing the can rim is not required. In addition, it is possible that the drawing punch simultaneously encompasses a part of the cutting device, whereby a very simple design of the cutting device can be attained with little installation space.

Preferably, the cutting device encompasses a force generating unit, which generates a force, which is directed at right angles to the longitudinal axis of the drawing punch. The force can be oriented radially or diagonally to the longitudinal axis of the drawing punch. The force acts at least on the rim of the can wall or of the can body, respectively, which is to be separated. By means of this force, the rim is pressed in particular radially inwardly towards the longitudinal axis of the drawing punch against at least one cutting edge, thus resulting in the cut-off of the rim. The at least one cutting edge is preferably provided at the drawing punch.

The force generating unit can cooperate with the can body in a contactless manner. In the case of a preferred exemplary embodiment, the force generating unit encompasses an electromagnet. The electromagnet generates a magnetic force, which is oriented substantially radially to the longitudinal axis of the drawing punch and which presses the rim, which is to be cut off, against a cutting edge. The electromagnet is preferably arranged coaxially to the longitudinal axis of the drawing punch or to the longitudinal axis of the wall ironing container, respectively.

A particularly economical and simple design of the device follows, when a part of the cutting device is provided at the drawing punch. Preferably, at least one cutting edge is arranged on the drawing punch. In the case of an exemplary embodiment, a first cutting edge at the drawing punch runs in circumferential direction about the longitudinal axis of the drawing punch and is closed in an in particular ring-shaped manner. The course of this first cutting edge defines the shape of the rim of the can body. Depending on the can body, which is to be produced, the first cutting edge can thus also have a different shape, depending on how the smooth rim of the can body, which is to be produced, is to run.

To be able to remove the separated ring-shaped closed rim from the drawing punch more easily, provision is made in the case of an advantageous exemplary embodiment for one or a plurality of second cutting edges. The at least one second cutting edge immediately follows the first cutting edge and extends at right angles thereto, for example parallel to the longitudinal axis of the drawing punch. The second cutting edge has the purpose of splitting the ring, which has been separated or which is to be separated, so that the cutting residues can be removed easily from the drawing punch, as long as the can body is still located on the drawing punch.

A shaping recess is present at the drawing punch adjacent to the at least one cutting edge and in particular adjacent to the first cutting edge. Said shaping recess provides a clearance, into which the force, which is generated by means of the force generating unit, can press the area of the can body, which adjoins the shaping recess. In response to this shaping of the can body, the material of the can body, which is pressed into the shaping recess, is separated or sheared off, respectively, by means of the adjoining cutting edge. On the side of the first cutting edge opposite the shaping recess, the drawing punch encompasses a support surface, against which the can body rests flatly and which is not deformed plastically or which is deformed plastically only insignificantly by means of the force of the force generating device.

A shaping recess is assigned to each first and second cutting edge. It is thereby possible for a shaping recess to be delimited by a plurality of cutting edges and to thus be assigned to a plurality of cutting edges.

Preferably, the at least one second cutting edge encompasses a smaller distance to the longitudinal axis of the drawing punch than the first cutting edge. It is thus ensured that the rim of the can wall or of the can body, respectively, is separated at the first cutting edge and at the at least one second cutting edge.

In the case of an advantageous embodiment, the device also encompasses a removal device, which can be embodied as a suction device, for example. The cut-off rim or the parts of the cut-off rim, respectively, can be removed very easily via the removal device, as long as the can body is still located on the drawing punch.

Prior to the wall ironing process of the blank, the latter can be clamped against a clamping surface by means of a blank holder of the device. The clamping surface can be provided adjacent to the opening of the wall ironing container. Preferably, the clamping surface and/or the wall ironing container is arranged so as to be immovable relative to the machine frame of the device. The wall ironing force generated between the drawing punch and the wall ironing container is thus supported directly by means of the machine frame.

Advantageous embodiments of the device and of the method according to the instant invention follow from the dependent patent claims as well as from the description. The description is limited to advantageous embodiments of the invention as well as to other factors. The invention is explained in the description of the figures by means of exemplary embodiments. The drawing is to be used in a supplementary manner.

DETAILED DESCRIPTION

Figure 1:
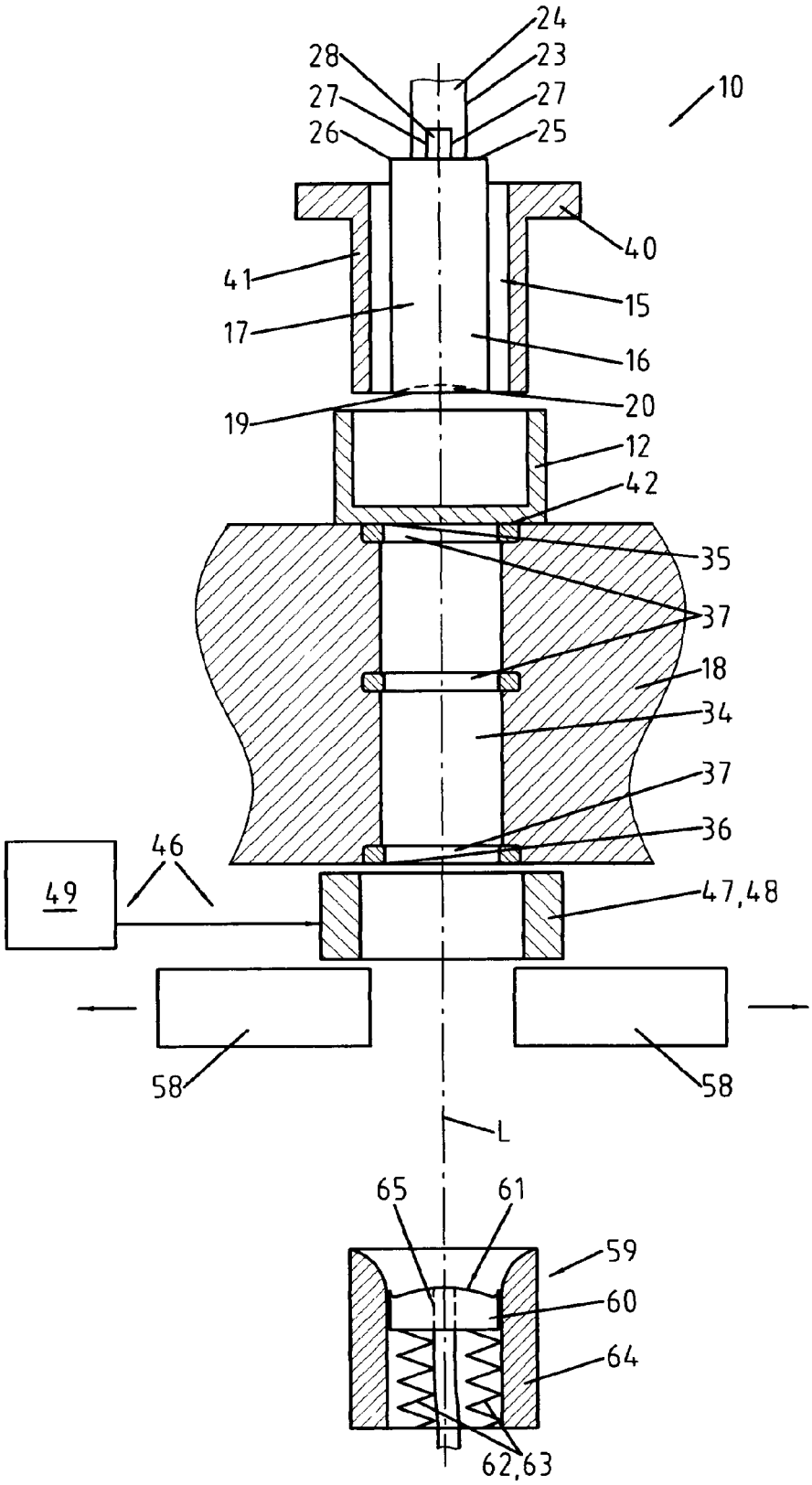
FIGS. 1 to 4 show a schematic, block diagram-like, cut illustration of an exemplary embodiment of the device in different states during the production of a can body.

The invention relates to a device 10 as well as to a method for producing a can body 11 from a blank 12. In the case of the exemplary embodiment of the device 10 or of the method described herein, respectively, the blank 12 is bowl-shaped or cup-shaped, respectively, and is also identified as "cup". The bowl-shaped blank 12 as well as the can body 11 are produced from a single part, which consists of a uniform material and which is embodied without seams or joints. The can body 11, which is to be produced, is therefore formed by a can base 13, which is adjoined by a can wall 14 without seams and joints and which encompasses a hollow-cylindrical shape.

The device 10 encompasses a drawing punch 15, which can be moved along a longitudinal axis L via a punch drive, which is not illustrated. The drawing punch 15 encompasses a first section 16 comprising a cylindrical jacket surface 17. At its axial end 19, which is assigned to a lower die 18, the drawing punch 15 encompasses a depression 20 in an exemplary manner. The shape of the axial end 19 is adapted to the desired shape of the can base 13.

A second section 23 adjoins the first section 16 of the drawing punch 15 on the side, which is located opposite the axial end 19. In the second section 23, an actuating rod 24 is connected to the cylindrical first section 16. In the transition area between the actuating rod 24 and the first section 16, a circumferential step 25 is formed. A first cutting edge 26 is formed at the transition point between the step 25 and the jacket surface 17 of the first section 16. The first cutting edge 26 runs around the longitudinal axis L as a closed loop and is circular, for example.

In the case of the preferred exemplary embodiment described herein, provision is made in addition to the first cutting edge 26 for a plurality of second cutting edges 27 at the drawing punch 15. The second cutting edges 27 immediately adjoin the first cutting edge 26 and run at right angles thereto. According to the example, the second cutting edges 27 run in a radial plane relative to the longitudinal axis L and in particular parallel to the longitudinal axis L of the drawing punch 15. The at least one second cutting edge 27 of the drawing punch 15 is arranged on at least one cutting projection 28. In the case of a first exemplary embodiment of the drawing punch 15 according to FIGS. 1 to 7, two cutting projections 28 are present, which project radially from the actuating rod 24, following the step 25. The two cutting projections 28 in each case encompass two second cutting edges 27. At each location, the at least one second cutting edge 27 has a distance from the longitudinal axis L of the drawing punch 15, which is smaller than the distance or the radius, respectively, of the first cutting edge 26. In the area of the cutting projections 28, the width of the step 25, which is measured radially to the longitudinal axis L, is smaller than in the area between the cutting projections 28.

The number of the second cutting edges 27 and/or the number of the cutting projections 28 can vary. In the case of the first exemplary embodiment according to FIGS. 1 to 7, the two cutting projections 28 are provided at diametrally opposite locations relative to the longitudinal axis L. In a modified embodiment of the drawing punch according to FIG. 9, four cutting projections 28 are arranged so as to be distributed evenly in circumferential direction about the longitudinal axis L. At that location, each cutting projection 28 only encompasses a second cutting edge 27. On principle, it can suffice to provide for a single second cutting edge 27. However, it is advantageous to provide for at least two second cutting edges, the distance of which in circumferential direction U about the longitudinal axis corresponds at least to a quadrant.

Figure 5:
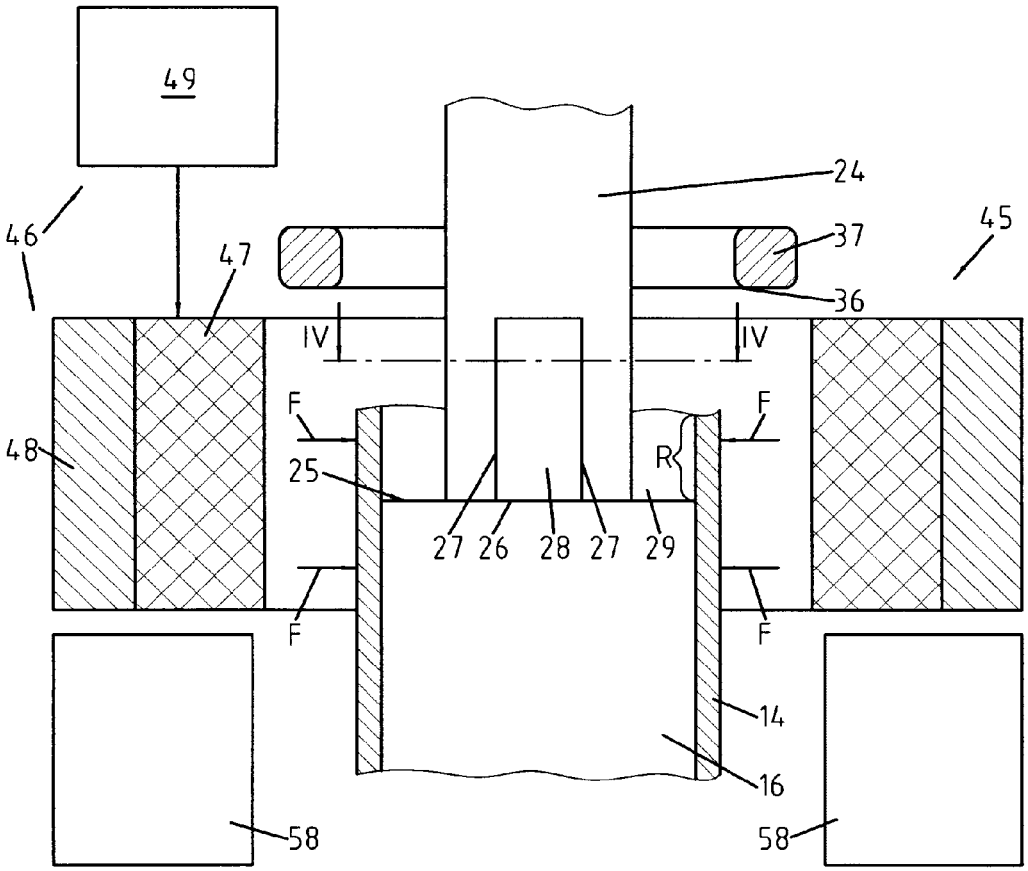
FIG. 5 shows a detailed view of the cutting device of the exemplary embodiment of the device.
Figure 6:
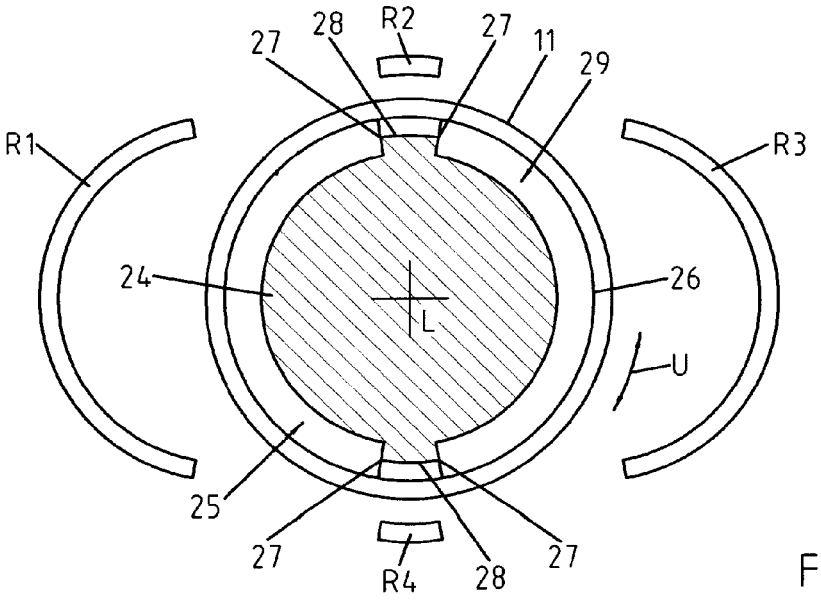
FIG. 6 shows a view of the drawing punch in the area of the cutting edges in cross section according to the sectional line VI-VI in FIG. 5.
Figure 7:
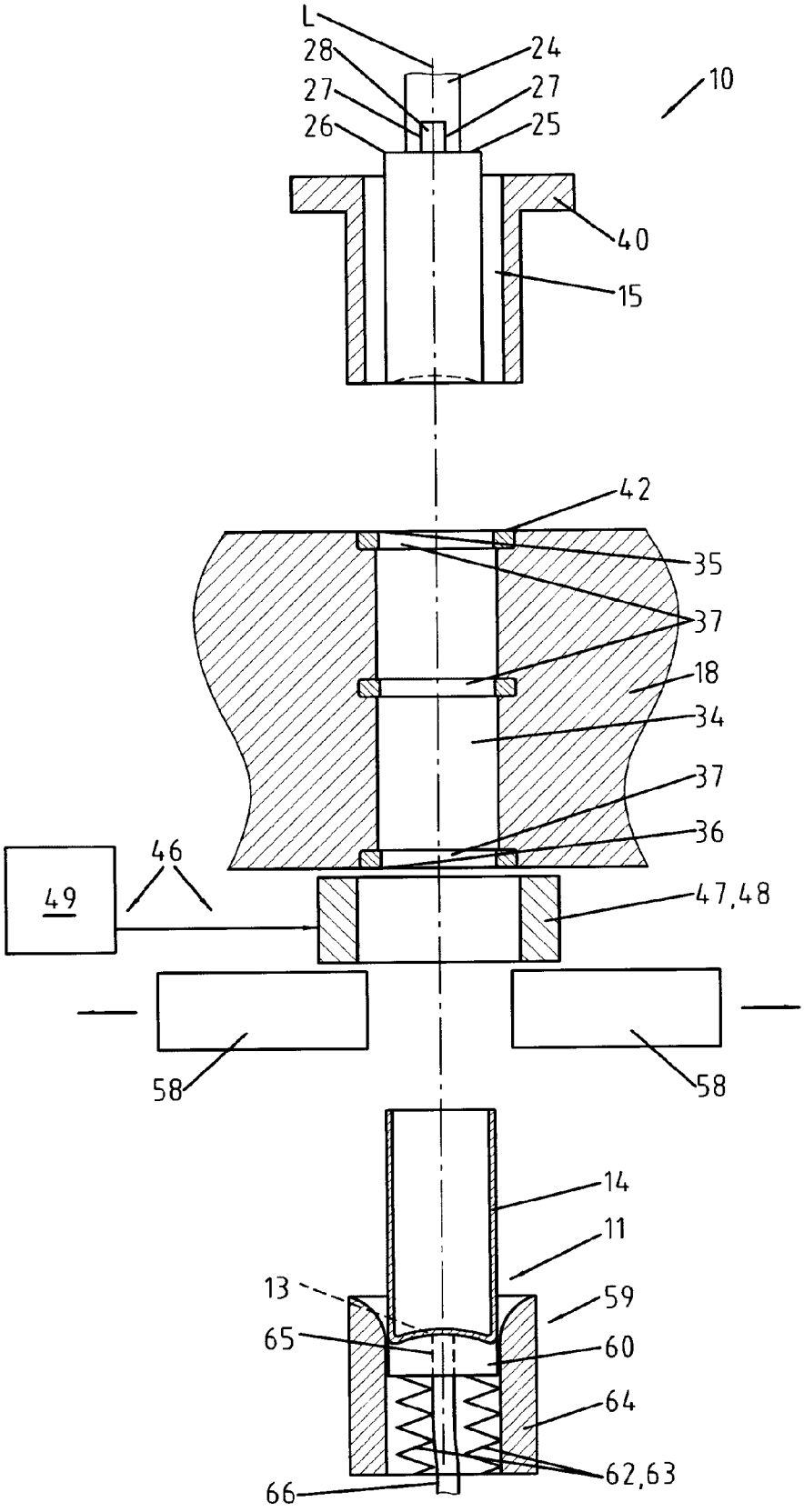
FIG. 7 shows the exemplary embodiment of the device according to FIGS. 1 to 6 comprising the completed can body.
Figure 9:
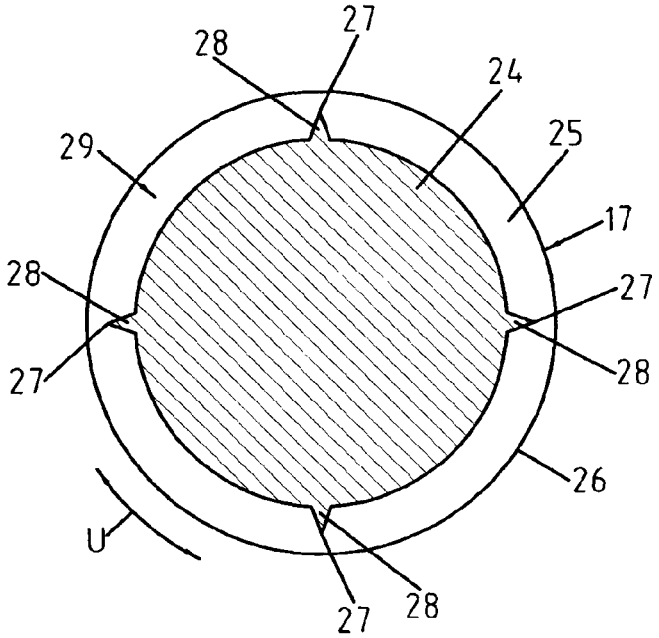

In the area of the step 25, a shaping recess 29 is formed at the drawing punch 25 in the second section 23 (FIGS. 5, 6, 9). The shaping recess 29 is defined by the clearance between a cylindrical surface about the longitudinal axis L comprising the radius of the first cutting edge 26 and the second section 23 of the drawing punch 15, thus the cutting projections 28 or the cutting edges 27, respectively, or the actuating rod 24. According to the width of the step 25, which is measured radially to the longitudinal axis L, this clearance is smaller in the area of the cutting projections 28 than in circumferential direction U between the cutting projections 28.

At the lower die 18, the device 10 encompasses a wall ironing container 34. The wall ironing container 34 or the lower die 18, respectively, are arranged immovably at a machine frame of the device 10, which is not illustrated. The wall ironing container 34 is formed by a cylindrical channel, which extends along the longitudinal axis L from an opening 35 to an exit 36. The wall ironing container 34 can be divided into cylindrical sections having the same diameter. It includes at least one and, according to the example, a plurality of wall ironing rings 37, the diameters of which vary. The wall ironing ring 37 comprising the largest diameter is arranged closest to the opening 35. The wall ironing ring 37 comprising the smallest diameter is arranged closest to the exit 36. The diameter of the wall ironing container 34 can be reduced in sections, in each case following a wall ironing ring 37 and can correspond to the diameter of the adjacent wall ironing ring 37, viewed in the direction of the opening 35. The number of wall ironing rings 37 can vary. On principle, more than three wall ironing rings are provided. This depends on the size and on the wall thickness of the blank 12 and on the desired size and wall thickness of the can body 11, which is to be produced.

Figure 2:
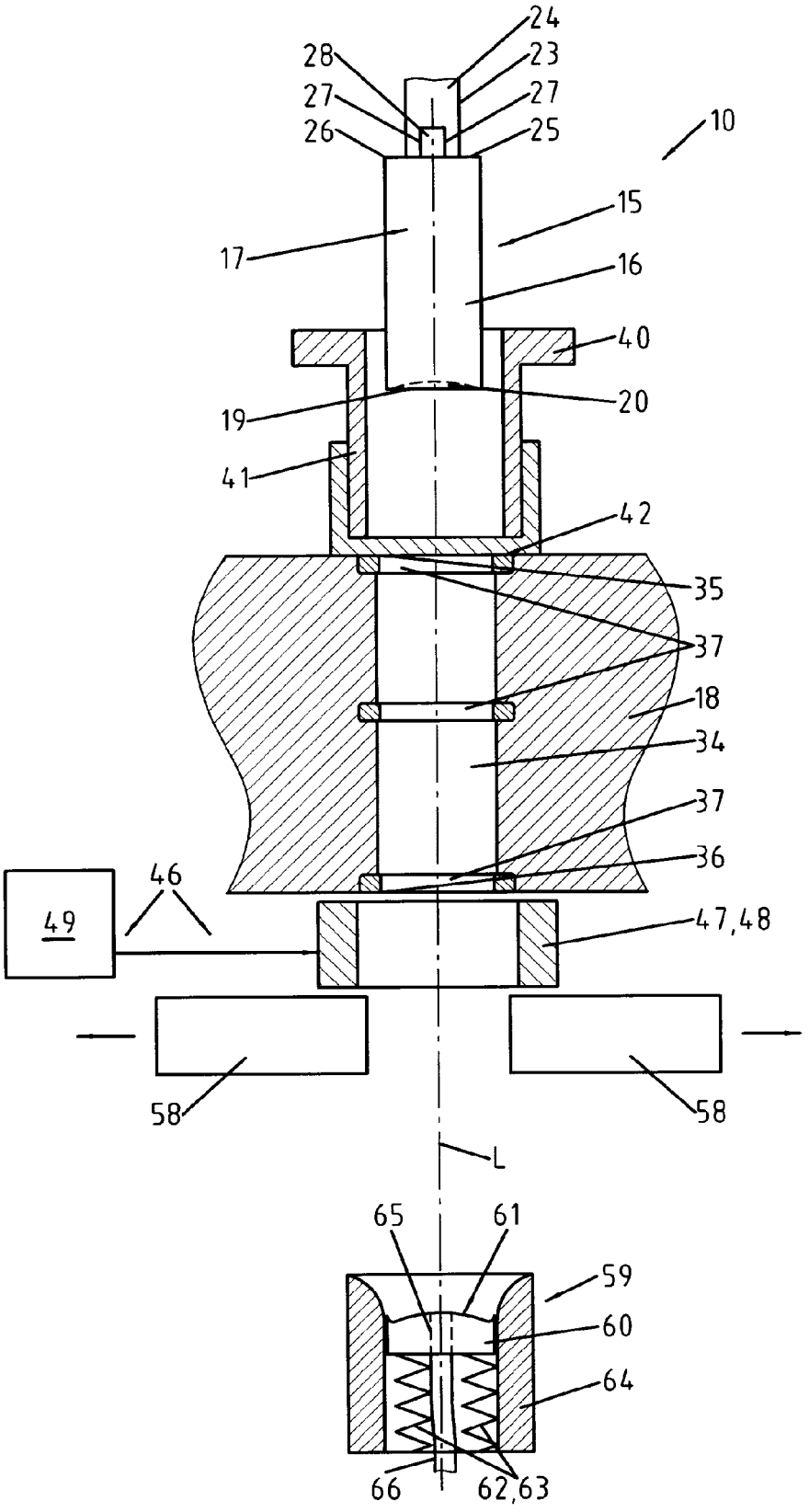

Coaxially to the drawing punch 15, provision is made for a blank holder 40, which can be moved along the longitudinal axis L. The blank holder 40 encompasses a hollow-cylindrical clamping part 41, which serves to clamp the blank 12 in the area of the opening 35. The front surface of the clamping part 41, which is assigned to the lower die 18, thereby rests against the bottom of the blank 12 (FIG. 2). A clamping surface 42 is formed at the lower die 18 around the opening 35. The blank 12 can be clamped between said clamping surface 42 and the front surface of the clamping part 41 for a subsequent shaping by means of wall ironing. The inner diameter of the clamping part 41 corresponds at least to the inner diameter of the opening 35 of the wall ironing container 34.

The device 10 encompasses a cutting device 45. The cutting device 45 is illustrated in a schematic diagram in FIG. 5. The cutting device 45 includes a force generating unit 46, which is equipped to generate a force F, which is oriented at right angles to the longitudinal axis L of the drawing punch 15 and which acts at least on a section of the can body and in particular of the can wall 14. The cutting device 45 also includes the at least one cutting edge 26, 27, which, in the case of the exemplary embodiment described herein, is arranged on the drawing punch 15. As an alternative, the at least one cutting edge 26, 27 can also be arranged on a separate component.

The force generating unit 46 is arranged adjacent to the exit 36. In the case of the exemplary embodiment, it encompasses an electromagnet 47. The electromagnet 47 is formed by means of an electric coil. The electromagnet 47 is arranged coaxially to the longitudinal axis L, following the exit 36. The coil or the electromagnet 47, respectively, is surrounded coaxially by a support ring 48, which can be connected to the machine frame or the lower die 18. The force F, which acts between the electromagnet 47 and the can body 11, is thus supported via the support ring 48 by means of the lower die 18 or the machine frame, respectively.

Figure 8:
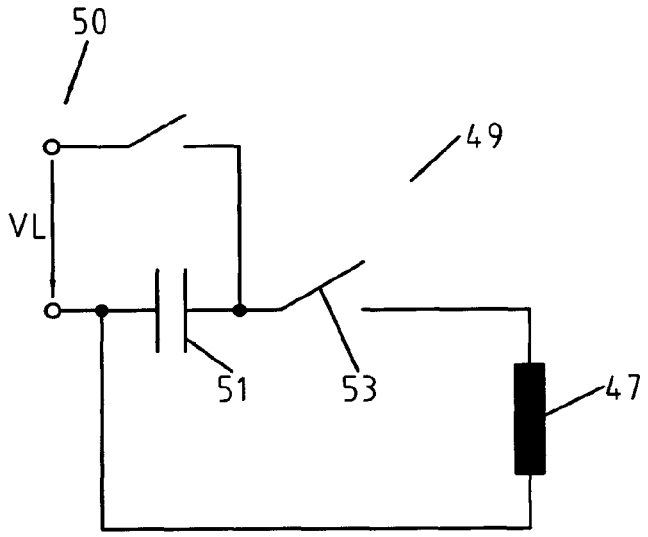
FIG. 8 shows an electric circuit diagram for an exemplary embodiment of the force generating device of the force generating unit of the cutting device and FIG. 9 shows an alternative embodiment of the drawing punch in the illustration according to FIG. 6.

The force generating unit 46 also includes a control circuit 49, the principle of which is illustrated in FIG. 8. The control circuit 49 encompasses a direct current voltage source 50 for applying a charging voltage VL to a capacitor 51. In the alternative, a direct current source can also be used. By closing a first switch 52, the charging current VL is applied to the capacitor 51. After completely charging the capacitor 51, the first switch 52 is opened again. The capacitor 51 can be electrically connected to the coil of the electromagnet 47 via a second switch 53. In the event that the second switch 53 is closed, the capacitor 51 and the coil of the electromagnet 47 form an oscillating circuit.

When closing the switch 53, a current flows through the coil of the electromagnet 47, because the capacitor 51 discharges. A voltage is thus induced in the coil and a magnetic field is generated, the field lines of which run approximately parallel to the longitudinal axis L in the interior of the coil. A current, which is directed in opposite direction of the current in the coil of the electromagnet 47, is induced through this in the section of the can body 11, which is located in the area of the electromagnet 47, so that a repulsive force F is caused due to the currents, which run in opposite direction in the electromagnet 47 and in the respective section of the can body 11. This force F can press the can body and the can wall 14, for example, radially inwardly towards the longitudinal axis L. In response to this shaping, the can wall 14 is separated along the cutting edges 26, 27.

Following the force generating unit 46, a removal device 58 is present. The removal device 58 serves the purpose of removing the parts separated from the can body 11. In the case of the exemplary embodiment, the removal device 58 is formed by means of a suction device, which generates an air flow, which is directed away from the longitudinal axis L. The cutting waste is sucked off.

Finally, a domer 59 is present along the longitudinal axis so as to be flush with the drawing punch 15. Together with the drawing punch 15 and in particular the axial end 19 of the drawing punch 15, the domer 59 is equipped to bring the can base 13 into the desired shape. According to the example, the drawing punch 15 encompasses a concave depression 20 at its axial end 19, as explained above. Accordingly, the domer 59 includes a molded part 60, comprising a spherical or convex front surface 61, respectively, which is adapted to the depression 20 and which is oriented at right angles to the longitudinal axis L and which faces the exit 36. In addition, the front surface 61 can encompasses a ring-shaped notch, which serves to form a ring-shaped rim at the can base 13 in the transition area to the can wall 14.

The molded part 60 can be displaced in the direction of the longitudinal axis L against the reset force of a resetting device 62. In the exemplary embodiment, the resetting device 62 is formed by means of a spring arrangement 63. The molded part 60 is displaceably supported so as to be guided in a cylindrical recess of a hollow-cylindrical guide part 64.

The molded part 60 of the domer 59 is permeated by a suction channel 65, which ends at the front surface 61 and which is arranged in particular along the longitudinal axis L. On its side, which is located opposite the front surface 61, the suction channel 65 is connected to a suction unit via a suction line 66. In the event that the can base 13 rests against the front surface 61 of the molded part 60, a low pressure can be generated between the can base 13 and the molded part 60, so as to hold the can body 11 at the domer 59 and so as to remove it from the drawing punch 15, if said can body moves away from the domer 59 along the longitudinal axis L. A stripping ring is thus not necessary in the area of the exit 36.

The method for producing the can body 11, which is carried out with the help of the device 10, operates as follows:

A blank 12 is supplied initially and is arranged above the opening 35 of the wall ironing container 34. The blank holder 40 is moved into the bowl-shaped blank 12 via a blank holder drive, which is not illustrated, so that the front side thereof clamps the base of the blank 12 against the clamping surface 42 around the opening 35 (FIGS. 1 and 2).

Figure 3:
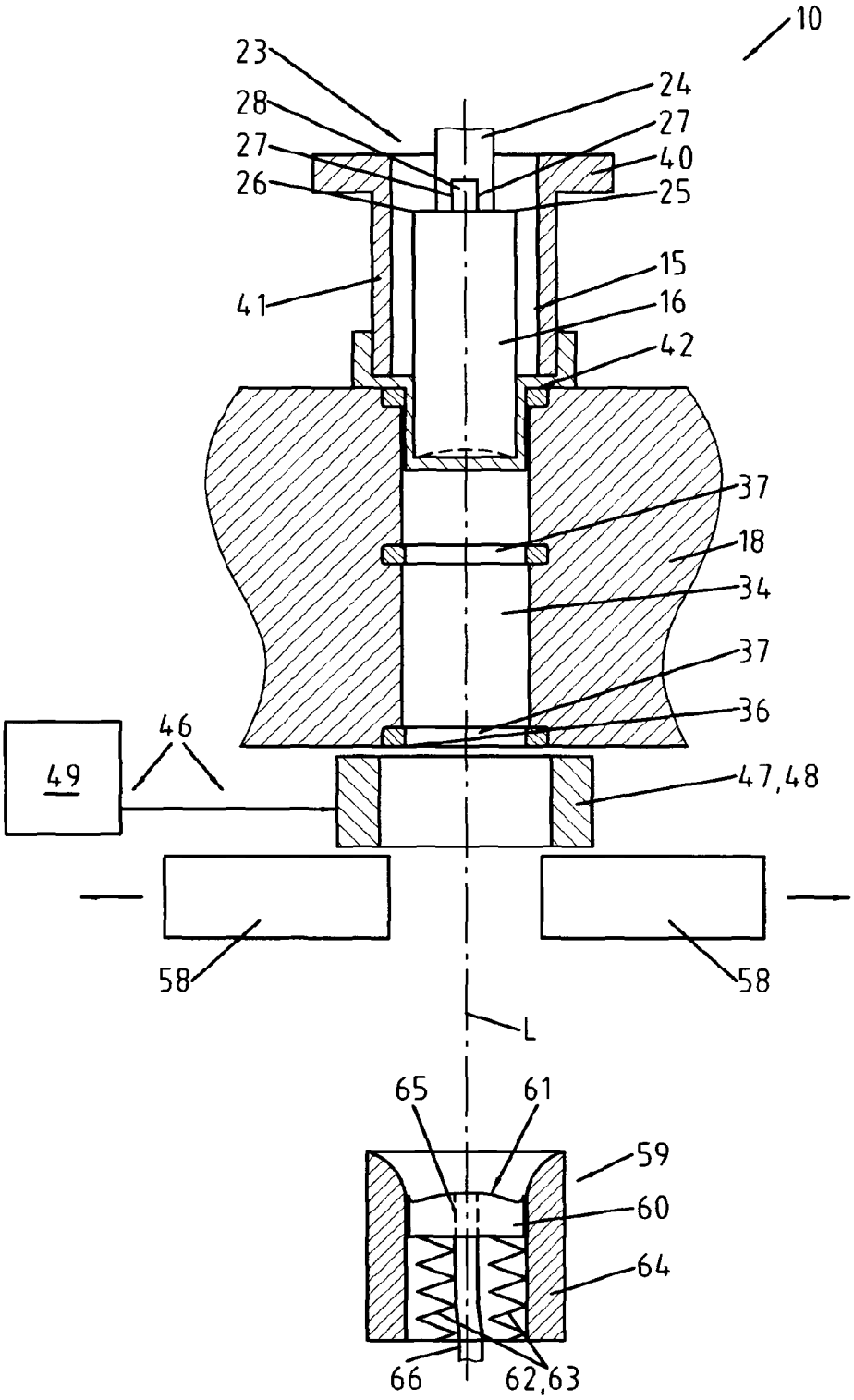
Figure 4:
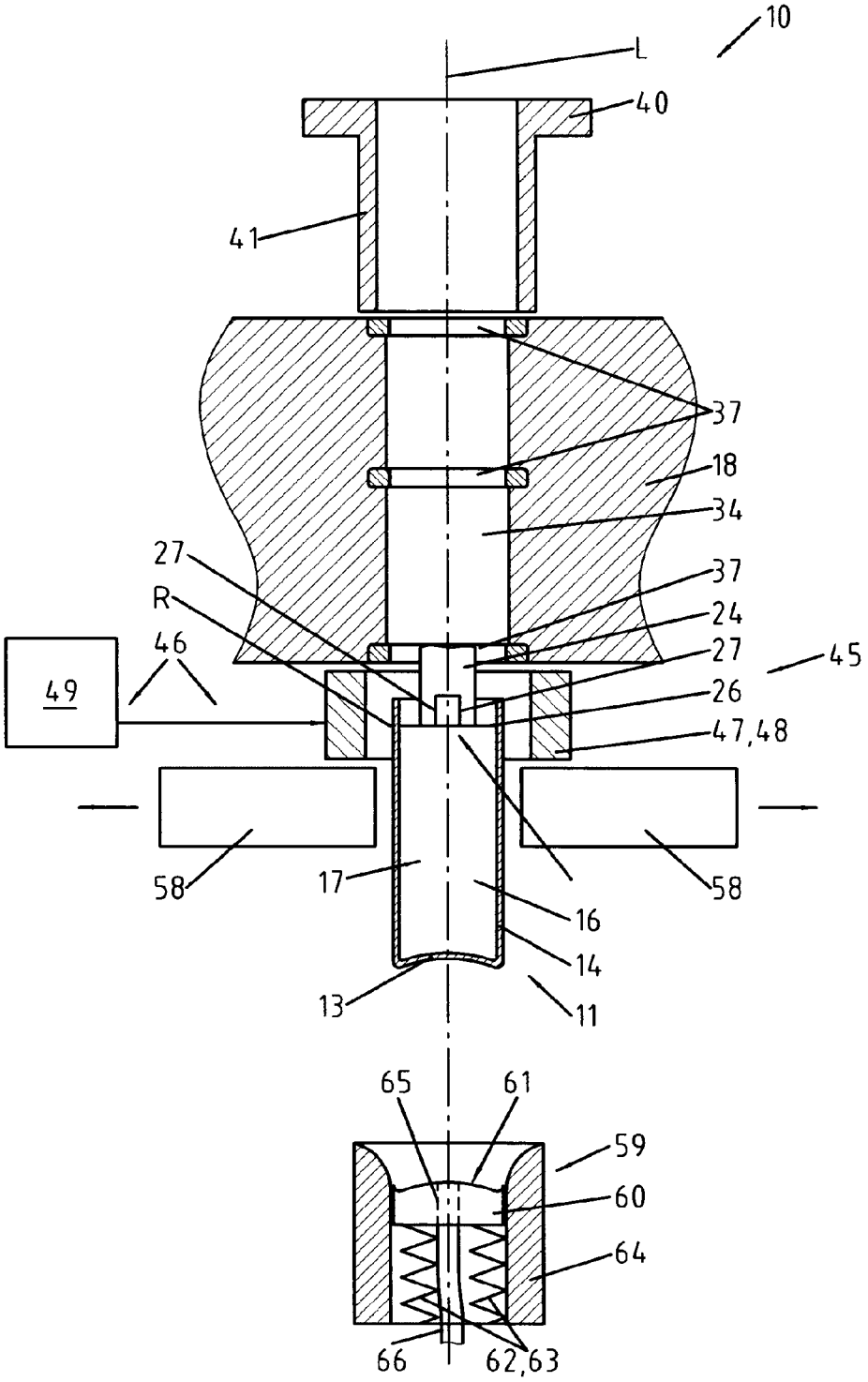

As is illustrated in FIG. 3, the drawing punch 15 is moved through the blank holder 40 into the blank 12 either subsequently or already simultaneously with the movement of the blank holder 40, so that the axial end 19 of the drawing punch 15 comes to rest against the base of the blank 12. A drawing punch drive, which is not illustrated, serves to move the drawing punch. Due to a continued movement of the drawing punch 15 into the wall ironing container 34, the blank 12 is pulled into the wall ironing container 34 little by little under the clamping force of the blank holder 40. The blank 12 is shaped into the can body 11 by means of a wall ironing process with the help of the wall ironing rings 37. The can body 11, which is shaped in this manner by means of a wall ironing process, is moved out of the wall ironing container 34 completely via the drawing punch 15. The magnetic force F, which serves as cutting force, is generated as soon as the rim R of the can wall 14, which is located opposite the can base 13, is positioned in the area of the force generating unit 46, and the rim R of the can wall 14 is separated from the can wall 14 along the first cutting edge 26.

By briefly supplying a current to the coil of the electromagnet 47, a force F, which is directed radially towards the longitudinal axis L, acts on the section of the can wall 14, which is arranged in the area of the electromagnet 47, as is illustrated in FIG. 5. The can wall 14 is supported by the jacket surface 17 in the area of the first section 16 and cannot deform or can deform only insignificantly by means of the acting force F. The first cutting edge 26 runs at the end of the jacket surface 17 in the transition area to the second section 23 of the drawing punch 15. In the second section 23, the rim R, which is to be cut off, is not supported against the force F, which acts on it, through the clearance or the shaping recess 29, respectively. The sheet material of the can wall 40 following the first cutting edge 26 is thus pressed radially inwardly and is separated from the can wall 14 along the first cutting edge 26. In addition, the ring-shaped rim R, which is separated along the first cutting edge 26, is split into a plurality of partial pieces and, according to the example, into four partial pieces R1 to R4, by means of the second cutting edges 27, which run parallel to the longitudinal axis L. The partial pieces R1 to R4 can be removed from the drawing punch 15 via the removal device 58, which is formed by the suction device, and can be transported into a waste container, for example.

The cutting force, which is formed by means of the magnetic force F, is thus generated by means of the force generating unit 46 without contact with the can body 11. The cutting edges 26, 27, which also belong to the cutting device 45, are arranged on the drawing punch 15 so as to save installation space.

After separating the rim R, the drawing punch 15 is moved further, so that the can base 13 comes to rest against the molded part 60 of the domer 59. When pressing the can base 13 against the front surface 61 of the molded part 60, the can base 13 is brought into the desired shape between the axial end 19 of the drawing punch 15 and the front surface 61 of the molded part 60. The shaping force is provided by the resetting device 62. A low pressure is generated after or also already during the shaping of the can base 13 via the suction channel 65 in the molded part 60 between the can base 13 and the front surface 61. The can body 11 is held against the molded part 60 in this manner. The completed can body can be removed from the drawing punch 15 by means of a movement of the drawing punch 15 along the longitudinal axis L, which is directed away from the domer 59. The can body 11 is thus only removed from the drawing punch 15, when the can base and the can wall 14 have been shaped and the rim R of the can wall 14, which is located opposite the can base 13, has been cut off.

In the case of the exemplary embodiment described herein, the first cutting edge runs about the longitudinal axis L in a circular manner. If it is desired to mold axial recesses or projections into the edge of the can wall 14, which is located opposite the can base 13, the first cutting edge 26 can encompass a corresponding shape.

The blank holder drive and/or the drawing punch drive can be formed by means of electric drives and preferably by servomotors. The blank holder drive and/or the drawing punch drive can thus be operated independent from one another in a force and/or position-controlled manner.

The invention relates to a method and to a device 10 for producing a can body 11, which encompasses a can base 13 and a can wall 14, which integrally adjoins said base. Starting with a blank 12, the can body 11 is shaped by means of a wall ironing process. For this purpose, a drawing punch 15 moves the blank 12 through a wall ironing container 34 from an opening 35 to an exit 36. After the wall ironing process, the rim R of the can body 11, which is shaped in the aforementioned manner and which is located opposite the can base 13, is separated with the help of a cutting device 45. The cutting device 45 encompasses a force generating unit 46, which is arranged adjacent to the exit 36, as well as at least one cutting edge 26, 27, which can in particular be arranged on the drawing punch 15. The force generating unit 46 generates a force F onto the rim R of the can wall 14, which is to be separated, whereby said rim is sheared off on the at least one cutting edge 26, 27. In response to the separation of the rim R, the can body 11 is located on the drawing punch 15. Subsequently, the can body 11, which was shaped by means of a wall ironing process and which was provided with a flat can wall edge, is removed from the drawing punch 15.

LIST OF REFERENCE NUMERALS

10 device
11 can body
12 blank
13 can base
14 can wall
15 drawing punch
16 first section
17 jacket surface
18 lower die
19 axial end
20 depression
23 second section

24 actuating rod
25 step
26 first cutting edge
27 second cutting edge
28 cutting projection
29 shaping recess
34 wall ironing container
35 opening
36 exit
37 wall ironing ring
40 blank holder
41 clamping part
42 clamping surface
45 cutting device
46 force generating unit
47 electromagnet
48 support ring
49 control circuit
50 direct current voltage source
51 capacitor
52 first switch
53 second switch
58 removal device
59 domer
60 molded part
61 front surface
62 resetting device
63 spring arrangement
64 guide part
65 suction channel
66 suction line
F force
L longitudinal axis
R rim
R1-R4 partial piece
U circumferential direction
VL charging voltage

The invention claimed is:

1. A device (10) for producing can bodies (11), the device comprising:

a drawing punch (15) for wall ironing a blank (12), in the case of which the blank (12) is shaped into a can body (11), a wall ironing container (34), through which the drawing punch (15) is configured to move the blank (12) from an opening (35) to an exit (36) during a wall ironing process, a cutting device (45) configured to cut off a rim (R) of the can body (11), which is adjacent to the exit (36), after the wall ironing process, wherein the cutting device comprises a force generating unit (46) comprising an electromagnet (47) configured to generate a magnetic force (F), which acts on the rim (R) of the can body (11); and wherein at least one cutting edge (26, 27) is arranged on the drawing punch (15) to cooperate with the cutting device to cut the rim (R) of the can body (11);

wherein a first cutting edge (26) of the at least one cutting edge, extending in a circumferential direction (U) relative to a longitudinal axis (L) of the drawing punch (15), is present at the drawing punch (15);

wherein at least one second cutting edge (27) of the at least one cutting edge, which runs at right angles to the first cutting edge (26), is present at the drawing punch (15) adjacent to the first cutting edge (26).

2. The device according to claim 1, wherein the force generating unit (46) is configured to generate the force (F) oriented at right angles to a longitudinal axis (L) of the drawing punch (15).

3. The device according to claim 2, wherein the electromagnet (47) is arranged coaxially to the longitudinal axis (L) of the drawing punch (15).

4. The device according to claim 1, further comprising a shaping recess (29) disposed at the drawing punch (15) adjacent to the at least one cutting edge (26, 27).

5. The device according to claim 1, wherein the at least one second cutting edge (27) has a smaller distance to the longitudinal axis (L) of the drawing punch (15) than the first cutting edge (26).

6. The device according to claim 1, further comprising a removal device (58) configured to suck off the cut-off rim (R, R1, R2, R3, R4), is disposed adjacent to the cutting device (45).

7. The device according to claim 6, wherein the removal device (58) is embodied as a suction device.

8. The device according to claim 1, further comprising a blank holder (40), configured to clamp a cup-shaped blank (12) between the blank holder (40) and a clamping surface (42), is arranged coaxially to the drawing punch (15).

9. The device according to claim 8, wherein the clamping surface (42) is arranged immovably relative to a machine frame.

10. A method for producing can bodies (11), the method$_{13}$ comprising:

receiving a cup-shaped blank (12), wall ironing the blank (12) with a drawing punch (15) and a wall ironing container (34) for shaping the blank (12) into a can body (11) including moving the blank (12) from an opening (35) to an exit (36) of the wall ironing container (34), cutting off a rim (R) of the can body (11) using a cutting device (45) adjacent to the exit before the can body (11) is removed from the drawing punch (15), wherein the cutting off the rim further comprises applying a magnetic force (F) with an electromagnet to the rim (R) of the can body (11) to effect engaging the rim with:

at least one first cutting edge (26) extending in a circumferential direction (U) relative to a longitudinal axis (L) of the drawing punch (15), and at least one second cutting edge (27), which runs at right angles to the first cutting edge (26) and is present at the drawing punch (15) adjacent to the first cutting edge (26).

* * * * *